US008801642B1

(12) United States Patent
Slominski

(10) Patent No.: US 8,801,642 B1
(45) Date of Patent: Aug. 12, 2014

(54) MASSAGE TOOL

(76) Inventor: Arnold Slominski, Macomb Township, MI (US)

( * ) Notice: Subject to any disclaimer, the term of this patent is extended or adjusted under 35 U.S.C. 154(b) by 524 days.

(21) Appl. No.: 13/179,887

(22) Filed: Jul. 11, 2011

(51) Int. Cl.
*A61H 7/00* (2006.01)

(52) U.S. Cl.
USPC ..... 601/135; 601/134; 601/137; D24/214

(58) Field of Classification Search
CPC ... A61H 7/00; A61H 7/003; A61H 2023/002; A61H 2201/0153; A61H 2201/0207; A61H 2201/0228; A61H 2201/0257; A61H 2201/0292; A61H 2201/10; A61H 2201/102; A61H 2201/1604; A61H 2205/021; A61H 2205/022; A61H 2205/125; A61H 2005/0659; A61N 2005/0659
USPC ..... 601/134, 135, 136, 137; 606/201, 204; D24/211, 214, 215; 482/44–50
See application file for complete search history.

(56) References Cited

U.S. PATENT DOCUMENTS

| | | | | |
|---|---|---|---|---|
| 4,732,142 | A | 3/1988 | Hurlburt et al. | |
| 4,989,585 | A | 2/1991 | Auker | |
| 5,085,207 | A | 2/1992 | Fiore | |
| 5,366,437 | A | 11/1994 | Graston | |
| 5,848,980 | A | 12/1998 | Demerais | |
| 6,077,239 | A | 6/2000 | Lin | |
| 6,241,694 | B1 | 6/2001 | Goulding-Thompson et al. | |
| 7,041,072 | B2 | 5/2006 | Calvert | |
| D542,926 | S * | 5/2007 | Louis | D24/214 |
| 7,320,668 | B1 | 1/2008 | Warder | |
| 7,481,783 | B1 | 1/2009 | Kelley | |
| D683,862 | S * | 6/2013 | Hartman | D24/214 |
| 2006/0293619 | A1 | 12/2006 | Louis | |
| 2007/0191745 | A1 * | 8/2007 | Tucker | 601/135 |
| 2012/0158040 | A1 * | 6/2012 | Dehors | 606/201 |

* cited by examiner

*Primary Examiner* — Quang D Thanh
(74) *Attorney, Agent, or Firm* — Young Basile Hanlon & MacFarlane P.C.

(57) ABSTRACT

A massage tool includes a body that extends from a first end to a second end in a lengthwise direction and has a first side that is spaced from a second side in a widthwise direction. The body defines a peripheral portion and an interior portion. The peripheral portion of the body has a substantially continuous outer periphery that is defined by a concave arc segment that is positioned along the first side of the body and a first convex arc segment that is positioned along the second side of the body. The interior portion has at least one lengthwise member that extends in the lengthwise direction of the body. The peripheral portion of the body cooperates with the interior portion of the body to define a first central aperture that extends through the body and a second central aperture that extends through the body.

16 Claims, 3 Drawing Sheets

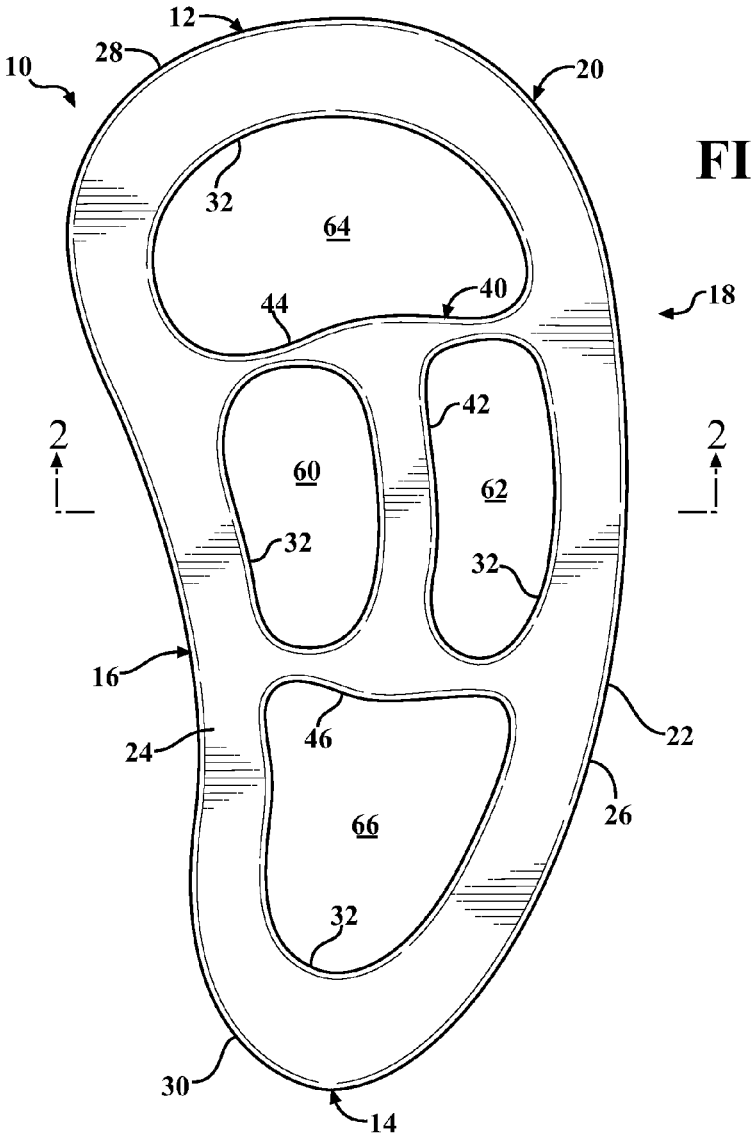
FIG. 1
FIG. 2
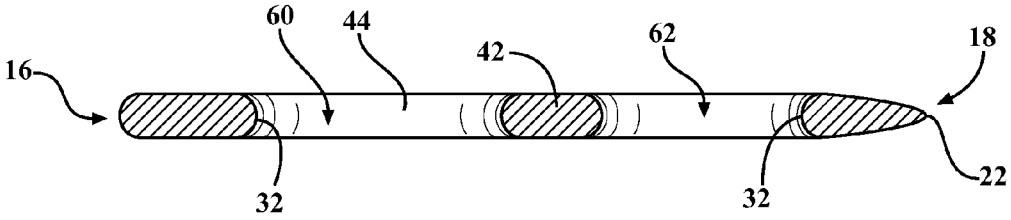

FIG. 5
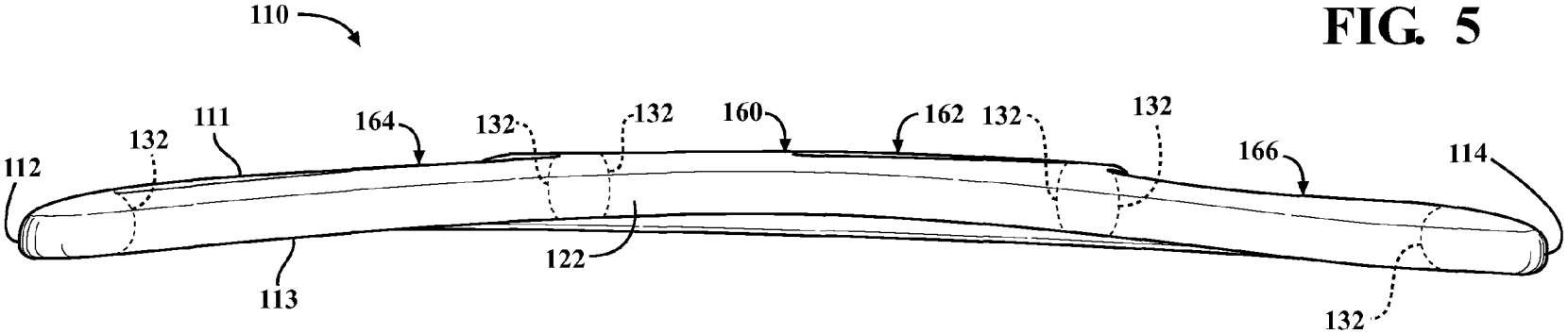
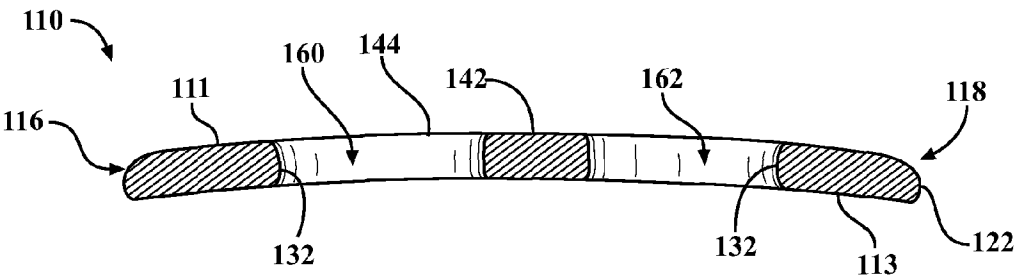
FIG. 6

MASSAGE TOOL

TECHNICAL FIELD

The disclosure herein relates generally to the field of massage, and more particularly, to handheld massage tools.

BACKGROUND

Massage is typically performed by applying pressure to the body of a patient, either manually or using a massage tool. Massage tools typically include some manner of surface or feature that is designed to contact the patient's body for the purpose of manipulating the patient's muscle tissue or connective tissue.

A vast array of massage tools have been used in the past. Many previously-used tools are awkward to hold and thus difficult to use. Other tools, while useful for their intended purpose, are specially adapted to manipulation of a particular part of the patient's body and lack versatility. Need remains for improved massage tools that are easy to manipulate, comfortable to hold, and versatile.

SUMMARY

One massage tool taught herein includes a body that extends from a first end to a second end in a lengthwise direction and has a first side that is spaced from a second side in a widthwise direction. The body defines a peripheral portion and an interior portion. The peripheral portion of the body has a substantially continuous outer periphery that is defined by a concave arc segment that is positioned along the first side of the body and a first convex arc segment that is positioned along the second side of the body. The interior portion has at least one lengthwise member that extends in the lengthwise direction of the body. The peripheral portion of the body cooperates with the interior portion of the body to define a first central aperture that extends through the body and a second central aperture that extends through the body.

Another massage tool taught herein includes a body that extends from a first end to a second end in a lengthwise direction and has a first side that is spaced from a second side in a widthwise direction. The body defines a peripheral portion and an interior portion. The peripheral portion has a substantially continuous outer periphery that is defined by a concave arc segment that is positioned along the first side of the body and a first convex arc segment that is positioned along the second side of the body. The interior portion has at least one lengthwise member that extends in the lengthwise direction of the body, a first widthwise member that extends in the widthwise direction of the body, and a second widthwise member that extends in the widthwise direction of the body. The lengthwise member of the interior portion of the body extends from the first widthwise member to the second widthwise member. The peripheral portion of the body cooperates with the interior portion of the body to define a first central aperture that extends through the body and a second central aperture that extends through the body. The first central aperture and the second central aperture are separated from one another by the lengthwise member of the interior portion of the body and are side-by-side with one another in the widthwise direction of the body.

Another massage tool taught herein includes a body that defines a peripheral portion and an interior portion. The peripheral portion has a substantially continuous outer periphery consisting of a single concave arc segment and one or more convex arc segments. The interior portion has at least one member. The peripheral portion of the body cooperates with the interior portion of the body to define a first central aperture that extends through the body and a second central aperture that extends through the body. The first central aperture is separated from the second central aperture by the at least one member of the interior portion of the body.

BRIEF DESCRIPTION OF THE DRAWINGS

The various features, advantages and other uses of the present apparatus will become more apparent by referring to the following detailed description and drawing in which:

FIG. 1 is a top view showing a massage tool;

FIG. 2 is a cross-sectional end view of the massage tool of FIG. 1;

FIG. 5 is a side view showing an alternative massage tool; and

FIG. 6 is a cross-sectional end view of the massage tool of FIG. 5.

DETAILED DESCRIPTION

Figure 3:
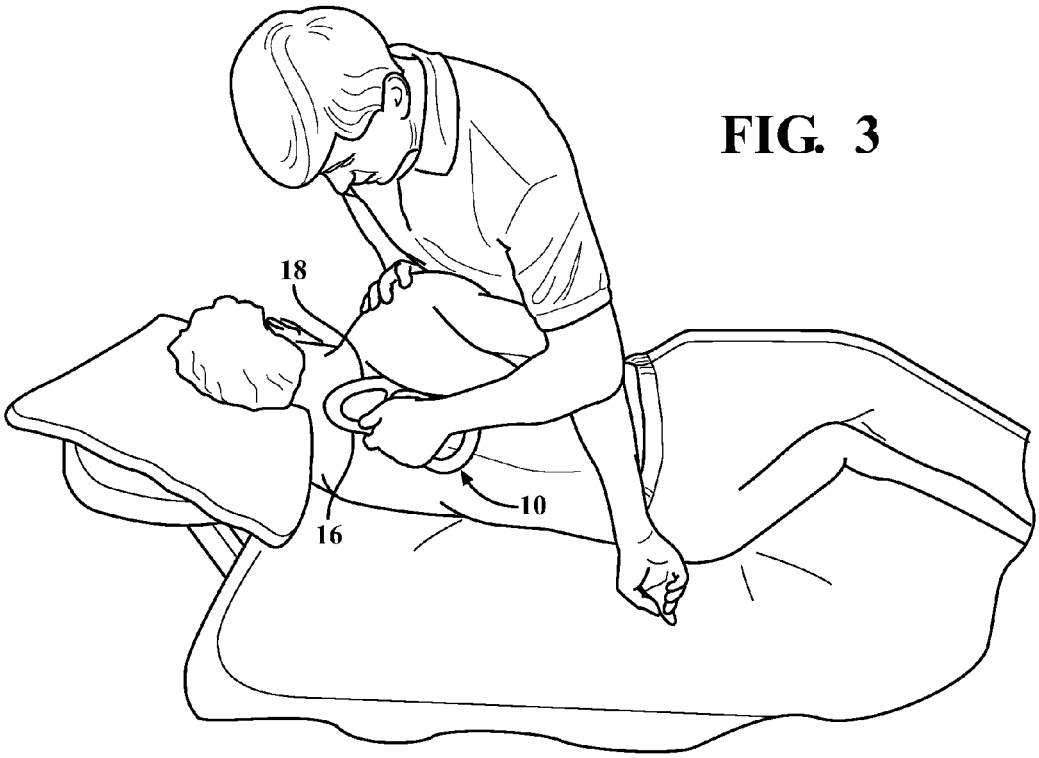
FIG. 3 shows the massage tool of FIG. 1 being applied to the body of a patient while held by a therapist in a first orientation.

FIGS. 1-2 show a massage tool in the form of a body 10. The body 10 extends from a first end 12 to a second end 14 in a lengthwise direction. The body 10 has a first side 16 that is spaced from a second side 18 in a widthwise direction.

The length of the body 10 as measured in the lengthwise direction is longer than the width of the body 10 as measured in the widthwise direction. As an example, the length of the body 10 in the lengthwise direction can be between 240-300 mm. The width of the body 10 at its widest point in the widthwise direction can be between 120-150 mm. As another example, the length of the body 10 in the lengthwise direction can be approximately 270 mm, and the width of the body 10 in the widthwise direction can be approximately 133 mm. The body 10 can have a volume of approximately 133 cubic centimeters.

The body 10 includes a peripheral portion 20 and an interior portion 40. The peripheral portion 20 of the body 10 cooperates with the interior portion 40 of the body 10 to define a plurality of apertures. The plurality of apertures can include a first central aperture 60, a second central aperture 62, a first end aperture 64, and a second end aperture 66. The first central aperture 60, the second central aperture 62, the first end aperture 64, and the second end aperture 66 all extend through the body 10 in a direction that is substantially orthogonal to both the lengthwise direction and the widthwise direction of the body 10.

The peripheral portion 20 of the body 10 has a substantially continuous outer periphery 22. The outer periphery 22 is substantially free of projections, recesses, angular discontinuities, or other discontinuities. Because the outer periphery 22 is substantially continuous, all parts of the outer periphery 22 of the peripheral portion 20 of the body 10 can be applied to the body of the patient without applying undue pressure that would be caused if localized discontinuities were present in the body 10.

The outer periphery 22 is defined by a plurality of arc segments that define the substantially continuous shape of the outer periphery 22. In the exemplary embodiment shown in FIG. 1, the body 10 includes a single concave arc segment 24, a first convex arc segment 26, a second convex arc segment 28, and a third convex arc segment 30.

The concave arc segment 24 is positioned along the first side 16 of the body 10 and extends a majority of the length of the body 10 in the lengthwise direction. The first convex arc segment 26 is positioned along the second side 18 of the body, opposite the concave arc segment 24. The first convex arc segment 26 extends a majority of the length of the body 10 in the lengthwise direction of the body 10. As shown in FIG. 2, the depth of the body 10 tapers progressively from an inner periphery 32 of the peripheral portion 20 toward the outer periphery 22 of the peripheral portion 20 in the area of the first convex side 26. This defines a roughly triangular, tapered cross-sectional profile for the peripheral portion 20 of the body 10 along the first convex side 26.

The second convex arc segment 28 is positioned at the first end 12 of the body 10. The second convex arc segment 28 extends from the first convex arc segment 26 to the concave arc segment 24.

The third convex arc segment 30 is positioned at the second end 14 of the body 10. The third convex arc segment 30 extends from the concave arc segment 24 to the first convex arc segment 26.

The peripheral portion 20 of the body 10 also includes the inner periphery 32. The inner periphery 32 of the peripheral portion 20 is discontinuous. In particular, the inner periphery 32 is interrupted by the interior portion 40 of the body 10. The inner periphery 32 of the peripheral portion 20 partially defines the boundaries of each of the first central aperture 60, the second central aperture 62, the first end aperture 64, and the second end aperture 66.

The interior portion 40 of the body 10 includes a lengthwise member 42, a first widthwise member 44, and a second widthwise member 46. The lengthwise member 42 extends in the lengthwise direction of the body 10. The first widthwise member 44 and the second widthwise member 46 each extend in the widthwise direction of the body 10.

The first widthwise member 44 and the second widthwise member 46 each extend across the body 10 from the inner periphery 32 of the peripheral portion 20 at the first side 16 of the body 10 to the inner periphery 32 of the peripheral portion 20 at the second side 18 of the body 10. The first widthwise member 44 and the second widthwise member 46 each extend generally transverse to the first side 16 and the second side 18 of the body 10.

The lengthwise member 42 of the interior portion 40 of the body 10 extends from the first widthwise member 44 to the second widthwise member 46. Thus, the first widthwise member 44 and the second widthwise member 46 are spaced apart by the length of the lengthwise member 42. As an example, the lengthwise member 42 can be approximately two and one-half inches long.

The lengthwise member 42 extends substantially transverse to the first widthwise member 44 and the second widthwise member 46. The lengthwise member 42, the first widthwise member 44, and the second widthwise member 46 cooperate to define a substantially H-shaped configuration for the interior portion 40 of the body 10. This H-shaped configuration of the interior portion 40 of the body 10 cooperates with the peripheral portion 20 of the body 10 to define the first central aperture 60, the second central aperture 62, the first end aperture 64, and the second end aperture 66.

The first central aperture 60 and the second central aperture 62 are separated from one another by the lengthwise member 42 of the interior portion 40 of the body 10. Thus, the first central aperture 60 and the second central aperture 62 are side-by-side with one another in the widthwise direction of the body. The first central aperture 60 is adjacent to the first side 16 of the body 10. The second central aperture 62 is adjacent to the second side 18 of the body 10.

The first central aperture 60 and the second central aperture 62 are similar to one another in length and width. The first central aperture 60 and the second central aperture 62 are approximately the same length as the lengthwise member 42 of the interior portion 40 of the body 10, since the first central aperture 60 and the second central aperture 62 each extend from the first widthwise member 44 to the second widthwise member 46 of the central portion 40. The lengths of each of the central aperture 60 and the second central aperture 62 in the lengthwise direction of the body 10 are longer than their widths, and the first central aperture 60 and the second central aperture 62 may be approximately twice as long as they are wide.

The first central aperture 60 is bordered by the inner periphery 32 of the peripheral portion 20 of the body 10, as well as by the first widthwise member 44, the second widthwise member 46, and the lengthwise member 42 of the interior portion 40 of the body 10. The second central aperture 62 is bordered by the inner periphery 32 of the peripheral portion 20 of the body 10, as well as by the first widthwise member 44, the second widthwise member 46, and the lengthwise member 42 of the interior portion 40 of the body 10.

The first end aperture 64 is positioned adjacent to the first end 12 of the body 10. The first end aperture 64 is positioned between the first end 12 of the body 10 and the first widthwise member 44 of the interior portion 40 of the body 10.

The second end aperture 66 is positioned adjacent to the second end 14 of the body 10. The second end aperture 66 is positioned between the inner periphery 32 of the peripheral portion 20 of the body 10 at the second end 14 thereof and the second widthwise member 46.

Figure 4:
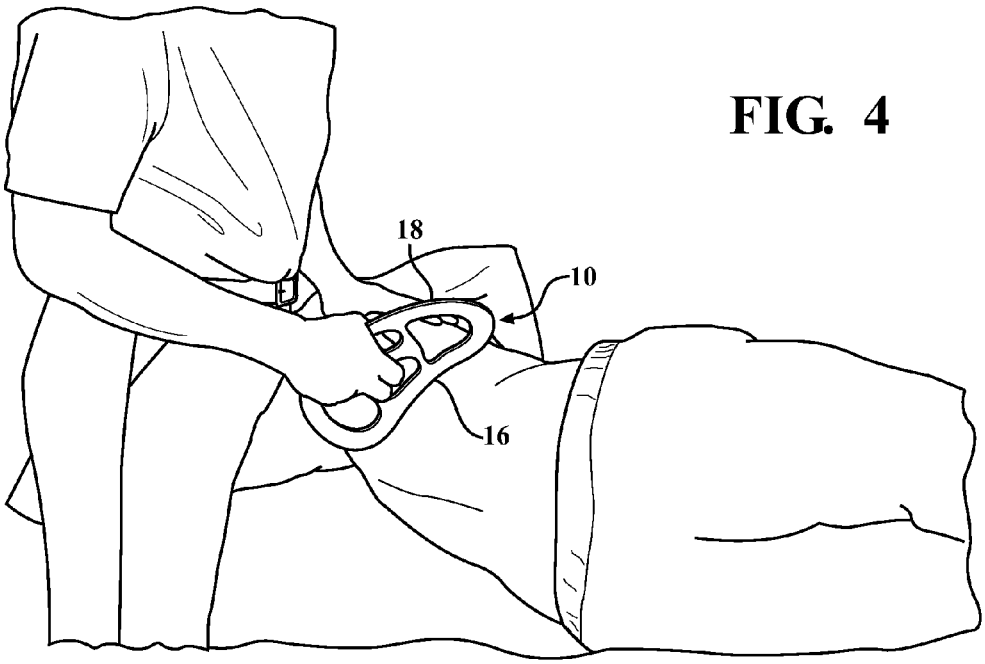
FIG. 4 shows the massage tool of FIG. 1 being applied to the body of the patient while being held by the therapist in a second orientation.

In use, a massage therapist holds the body 10 by grasping the peripheral portion 20 and at least part of the interior portion 40 of the body 10. The body 10 can be grasped in a number of suitable ways, owing to the H-shaped configuration of the interior portion 40 of the body 10. For example, the body 10 can be grasped at the first side 16 such that the second side 18 is engaged with the body of the patient, as shown in FIG. 3. This places the first concave arc segment 26 of the outer periphery 22 of the peripheral portion 20 in contact with the body of the patient. As another example, the body 10 can be grasped by the massage therapist at the second side 18 such that the first side 16 of the body 10 is placed in contact with the body of the patient, as shown in FIG. 4. This places the concave arc segment 24 of the outer periphery 22 of the peripheral portion 20 of the body 10 in contact with the body of the patient. Once the body 10 is grasped as desired and placed in contact with the body of the patient, the massage therapist utilizes the body 10 to perform the massage by selectively applying pressure to the body of the patient using the body 10.

An alternative massage tool having a body 110 that, instead of being substantially planar, has a slight curvature applied to a top surface 111 and a bottom surface 113 thereof. As shown in FIG. 5, an end-to-end curvature is applied to the top surface 111 and the bottom surface 113 extending from a first end 112 to a second end 114 of the body 110. The end-to-end curvature that is applied to each of the top surface 111 and the bottom surface 113 can be a circular curvature of substantially constant radius. Alternatively, the curvature could have a varying radius along its length. Similarly, a side-to-side curvature is applied to the top surface 111 and the bottom surface 113 in a direction extending from a first side 116 to a second side 118 of the body 110. As with the end-to-end curvature, the side-to-side curvature can be circular or non-circular. Furthermore, it is specifically contemplated that the body 110 includes both the side-to-side curvature and the end-to-end curvature. This results in a shape for the body 110 that is equivalent to that of a portion of a sphere. However, it is also contemplated that each of the side-to-side curvature and the end-to-end curvature could be applied to the body 110 individually. For example, the body 110 could have an end-to-end curvature but also have no side-to-side curvature.

The remaining portions of the body 110 are substantially identical to equivalent portions of the body 10. In particular, an outer periphery 122, a plurality of inner peripheries 132, a lengthwise member 142, one or more widthwise members, including a first widthwise member 144, a first central aperture 160, a second central aperture 162, a first end aperture 164, and a second end aperture 166 of the body 110 are all equivalent to similarly named and numbered portions of the body 10.

The disclosure herein is directed to what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A massage tool, comprising:

a body that extends from a first end to a second end in a lengthwise direction and has a first side that is spaced from a second side in a widthwise direction, the body defining:

a peripheral portion having substantially continuous outer periphery that is defined by a concave arc segment that is positioned along the first side of the body and a first convex arc segment that is positioned along the second side of the body, and an interior portion including at least one lengthwise member that extends in the lengthwise direction of the body, a first widthwise member that extends in the widthwise direction of the body, and a second widthwise member that extends in the widthwise direction of the body, wherein the peripheral portion of the body cooperates with the interior portion of the body to define a first central aperture that extends through the body, a second central aperture that extends through the body, a first end aperture that is positioned adjacent to the first end of the body between the peripheral portion of the body and the first widthwise member of the interior portion of the body and a second end aperture that is positioned adjacent to the second end of the body between the peripheral portion of the body and the second widthwise member of the interior portion of the body.

2. The massage tool of claim 1, wherein the first central aperture and the second central aperture are separated from one another by the lengthwise member of the interior portion of the body.

3. The massage tool of claim 1, wherein the first central aperture and the second central aperture are side by side with one another in the widthwise direction of the body.

4. The massage tool of claim 1, wherein lengths of each of the first central aperture and the second central aperture in the lengthwise direction of the body are longer than the widths of the first central aperture and the second central aperture, respectively, in the widthwise direction of the body.

5. The massage tool of claim 1, wherein the length of the body as measured in the lengthwise direction is longer than the width of the body as measured in the widthwise direction.

6. The massage tool of claim 1, wherein the lengthwise member of the interior portion of the body extends from the first widthwise member to the second widthwise member.

7. The massage tool of claim 1, wherein the first central aperture and the second central aperture each extend from the first widthwise member of the interior portion of the body to the second widthwise member of the interior portion of the body.

8. The massage tool of claim 1, wherein the first central aperture and the second central aperture are each bordered by the first widthwise member of the interior portion of the body, the second widthwise member of the interior portion of the body, the lengthwise member of the interior portion of the body, and the peripheral portion of the body.

9. The massage tool of claim 8, wherein the first central aperture is positioned adjacent to the first side of the body and the second central aperture is positioned adjacent to the second side of the body.

10. The massage tool of claim 1, wherein the interior portion of the body has a substantially H-shaped configuration that cooperates with the peripheral portion of the body to define the first central aperture, the second central aperture, the first end aperture.

11. The massage tool of claim 1, wherein the substantially continuous outer periphery of the peripheral portion of the body is further defined by a second convex arc segment that is positioned at the first end of the body and a third convex arc segment that is positioned at the second end of the body.

12. A massage tool, comprising:

a body that extends from a first end to a second end in a lengthwise direction and has a first side that is spaced from a second side in a widthwise direction, the body defining:

a peripheral portion having substantially continuous outer periphery that is defined by a concave arc segment that is positioned along the first side of the body, a first convex arc segment that is positioned along the second side of the body, a second convex arc segment that is positioned at the first end of the body, and a third convex arc segment that is positioned at the second end of the body, wherein the second convex arc segment extends from the first convex arc segment to the concave arc segment and the third convex arc segment extends from the concave arc segment to the first convex arc segment, and an interior portion including at least one lengthwise member that extends in the lengthwise direction of the body, wherein the peripheral portion of the body cooperates with the interior portion of the body to define a first central aperture that extends through the body and a second central aperture that extends through the body.

13. A massage tool, comprising:

a body that extends from a first end to a second end in a lengthwise direction and has a first side that is spaced from a second side in a widthwise direction, the body defining:

a peripheral portion having substantially continuous outer periphery that is defined by a concave arc segment that is positioned along the first side of the body and a first convex arc segment that is positioned along the second side of the body, and an interior portion including at least one lengthwise member that extends in the lengthwise direction of the body, a first widthwise member that extends in the widthwise direction of the body, and a second widthwise member that extends in the widthwise direction of the body, wherein the lengthwise member of the interior portion of the body extends from the first widthwise member to the second widthwise member, wherein the peripheral portion of the body cooperates with the interior portion of the body to define a first central aperture that extends through the body, a second central aperture that extends through the body, a first end aperture that is positioned adjacent to the first end of the body between the peripheral portion of the body and the first widthwise member of the interior portion of the body, and a second end aperture that is positioned adjacent to the second end of the body between the peripheral portion of the body and the second widthwise member of the interior portion of the body, wherein the first central aperture and the second central aperture are separated from one another by the lengthwise member of the interior portion of the body and are side by side with one another in the widthwise direction of the body.

14. The massage tool of claim 13, wherein lengths of each of the first central aperture and the second central aperture in the lengthwise direction of the body are longer than the widths of the first central aperture and the second central aperture, respectively, in the widthwise direction of the body.

15. The massage tool of claim 14, wherein the length of the body as measured in the lengthwise direction is longer than the width of the body as measured in the widthwise direction.

16. The massage tool of claim 15, wherein the substantially continuous outer periphery of the peripheral portion of the body is further defined by a second convex arc segment that is positioned at the first end of the body and a third convex arc segment that is positioned at the second end of the body, the second convex arc segment extends from the first convex arc segment to the concave arc segment, and the third convex arc segment extends from the concave arc segment to the first convex arc segment.

* * * * *